US010265630B2

(12) United States Patent
VanDyke et al.

(10) Patent No.: US 10,265,630 B2
(45) Date of Patent: Apr. 23, 2019

(54) FLEXIBLE RIBBED PANEL

(71) Applicant: Lifetime Products, Inc., Clearfield, UT (US)

(72) Inventors: Lynn D. VanDyke, Layton, UT (US); Jacob Kearl, Willard, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 5 days.

(21) Appl. No.: 15/232,133

(22) Filed: Aug. 9, 2016

(65) Prior Publication Data

US 2016/0346703 A1 Dec. 1, 2016

Related U.S. Application Data

(63) Continuation of application No. 14/565,196, filed on Dec. 9, 2014, now Pat. No. 9,427,670.

(60) Provisional application No. 61/914,857, filed on Dec. 11, 2013, provisional application No. 61/914,874, filed on Dec. 11, 2013.

(51) Int. Cl.

| | |
|---|---|
| ***A63G 21/04*** | (2006.01) |
| *E04B 1/12* | (2006.01) |
| *A63G 31/00* | (2006.01) |

(52) U.S. Cl.

CPC ..... *A63G 21/04* (2013.01); *A63G 31/00* (2013.01)

(58) Field of Classification Search

CPC ..... A63G 21/00; A63G 21/02; A63G 21/04; A63G 21/18; E04B 1/00; E04B 1/12

USPC ..... 472/116–117, 128, 136; 52/64, 220.1, 52/220.4

See application file for complete search history.

(56) References Cited

U.S. PATENT DOCUMENTS

| | | | | |
|---|---|---|---|---|
| 2,841,396 | A | 7/1958 | Foss | |
| 3,045,961 | A * | 7/1962 | Cygan | A47F 5/0846 248/220.42 |
| 3,453,791 | A * | 7/1969 | Fork | H02G 3/283 174/486 |
| 4,270,748 | A | 6/1981 | Ray | |
| 4,299,171 | A | 11/1981 | Larson | |
| 4,932,648 | A * | 6/1990 | Ahrens | A63G 21/00 104/70 |
| 5,427,574 | A | 6/1995 | Donnelly-Weide | |
| 5,728,005 | A * | 3/1998 | Rothbard | A63G 21/00 472/116 |
| 5,860,867 | A | 1/1999 | Van Deusen | |
| 5,941,041 | A * | 8/1999 | Robinson | A63B 9/00 472/116 |
| 6,955,204 | B1 * | 10/2005 | Gilbert | E04B 2/7431 160/135 |
| D575,840 | S | 8/2008 | Sammann et al. | |

(Continued)

OTHER PUBLICATIONS

International Search Report and Written Opinion of PCT/US2014/069836 dated Mar. 2, 2015, filed Dec. 11, 2014.

(Continued)

*Primary Examiner* — Kien Nguyen

(74) *Attorney, Agent, or Firm* — Workman Nydegger

(57) ABSTRACT

In one example, a panel includes a series of hollow ribs arranged generally parallel to each other, and the hollow ribs define part of a first side of the panel. A flexible web is disposed between each two successive ribs of the plurality of ribs. The panel is made of plastic and is in the form of a unified single-piece structure in which the flexible webs are integral with the plurality of ribs.

22 Claims, 16 Drawing Sheets

(56) References Cited

U.S. PATENT DOCUMENTS

| | | | | |
|---|---|---|---|---|
| D601,220 | S | 9/2009 | Sammann et al. | |
| 7,662,045 | B2 | 2/2010 | Sammann et al. | |
| 2005/0210761 | A1* | 9/2005 | Mower | E04B 1/12 52/64 |
| 2006/0150569 | A1* | 7/2006 | Mettler | E01F 13/02 428/116 |
| 2007/0078014 | A1 | 4/2007 | Nye et al. | |
| 2011/0045250 | A1* | 2/2011 | De Zen | B29C 47/0019 428/168 |

OTHER PUBLICATIONS

Office Action of U.S. Appl. No. 14/565,196 dated Aug. 14, 2015, filed Dec. 9, 2014.
Office Action of U.S. Appl. No. 14/565,196 dated Feb. 19, 2016, filed Dec. 9, 2014.
Notice of Allowance of U.S. Appl. No. 14/565,196 dated May 6, 2016, filed Dec. 9, 2014.
International Preliminary Report on Patentability of PCT/US2014/069836 dated Jun. 23, 2016, filed Dec. 11, 2014.

* cited by examiner

FLEXIBLE RIBBED PANEL

RELATED APPLICATIONS

This application is a continuation, and hereby claims the benefit, of U.S. patent application Ser. No. 14/565,196, entitled PLAYGROUND SLIDE, filed Dec. 9, 2014 (the "'196 Application"). The '196 Application claims priority to: U.S. Provisional Patent Application Ser. 61/914,857, entitled PLAYGROUND SLIDE, filed Dec. 11, 2013 (the "'857 Application"); and, U.S. Provisional Patent Application Ser. 61/914,874, entitled FLEXIBLE RIBBED PANEL, filed Dec. 11, 2013 (the "'874 Application"). All of the aforementioned applications are incorporated herein in their respective entireties by this reference.

BACKGROUND

The present disclosure is generally concerned with panels. More specifically, various disclosed embodiments concern panels that include a rib structure that may lend strength and flexibility to a panel.

BRIEF SUMMARY OF SOME ASPECTS OF THE DISCLOSURE

It should be noted that the embodiments disclosed herein do not constitute an exhaustive summary of all possible embodiments, nor does this brief summary constitute an exhaustive list of all aspects of any particular embodiment(s). Rather, this brief summary simply presents selected aspects of some example embodiments. It should be noted that nothing herein should be construed as constituting an essential or indispensable element of any invention or embodiment. Rather, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular technical effect(s) or solution(s).

A. Example Elements of Slide Beds

Disclosed embodiments are generally concerned with playground equipment, such as slides, for example, and associated components. Embodiments of a slide bed within the scope of this disclosure may include any one or more of the following elements, and features of elements, in any combination: a slide bed in the form of a unitary one-piece structure and substantially comprising plastic; a slide bed substantially comprising a material other than plastic; a slide bed that includes one or more hollow portions; a slide bed that includes one or more hollow portions, and one or more of the hollow portions is a rib; a slide bed comprising a plurality of ribs; a slide bed comprising a plurality of lateral ribs; a slide bed including a plurality of hollow ribs; a slide bed that is substantially smooth on a first side and includes a plurality of ribs on a second, opposing, side; a substantially flexible slide bed; a substantially rigid slide bed; a slide bed that includes one or more substantially hollow portions; a slide bed that includes a plurality of tack-offs alternating with a plurality of flat ribs; a slide bed connectible to one or more side rails without the use of fasteners such as threaded fasteners (e.g., screws, bolts, screw nails), nails, or rivets; a slide bed that is substantially flexible along a first axis and substantially rigid, or at least substantially resistant to bending, along a second axis that is generally perpendicular to the first axis; a slide bed including a plurality of structural elements each configured to engage a corresponding structural element of a side rail; a slide bed including a plurality of slots configured to engage corresponding extended elements, such as posts, tabs, or pad eyes of a side rail; a slide bed including posts and hooks configured to engage corresponding structures of a side rail; a slide bed that is lockable to a side rail; a slide bed that is lockable to a side rail that does not include a longitudinal groove; a slide bed consisting of a single piece of material; a slide bed that engages a pair of side rails in such a way as to substantially retain the side rails in position relative to each other; a slide bed that engages a pair of side rails in such a way as to substantially prevent the side rails from moving relative to each other; a slide bed configured to be suspended beneath a pair of side rails; a slide bed configured to rest on a pair of side rails and be supported on its underside by the side rails; a slide bed that connects to a pair of side rails such that the slide bed is suspended beneath the pair of side rails, and the slide bed is supported beneath its underside by one or more support elements, wherein one or more of the support elements connects the side rails to each other; and, a slide bed that defines on its underside one or more recesses that are each configured to receive a portion of a respective support element.

B. Example Elements of Side Rails

Embodiments of a side rail of a slide bed within the scope of this disclosure may include any one or more of the following elements, and features of elements, in any combination: a side rail that connects to a slide bed without the use of fasteners such as threaded fasteners (e.g., screws, bolts, screw nails), nails, or rivets; a side rail configured to be held in position relative to another side rail by a slide bed; a side rail including a molded locking device operable to lock a slide bed to the side rail without the use of fasteners such as threaded fasteners (e.g., screws, bolts, screw nails), nails, or rivets; a side rail including a plurality of structural elements each configured to engage a corresponding structural element of a slide bed; a side rail including a plurality of extended elements, such as posts or tabs, each configured to engage a corresponding slot of a slide bed; a side rail in the form of a unitary one-piece structure and substantially comprising plastic; a side rail substantially comprising a material other than plastic; a side rail that is at least partly hollow; a side rail that is substantially hollow; a side rail that includes one or more tack-offs; a grooveless side rail connectible to a slide bed; a side rail connectible to an underside of a slide bed; a side rail configured to snap lock together with a slide bed; a side rail that cooperates with another side rail to suspend a slide bed beneath the side rails; and, a side rail that cooperates with another side rail to support the underside of a slide bed resting on the side rails; a side rail including one or more pad eyes; a side rail including one or more extended elements configured to releasably engage a slide bed; a side rail including both a pad eye and an extended element, where one, or both, of the pad eye and extended element are integral with the side rail and arranged to interface with a slide bed; a side rail including a pad eye configured to receive a portion of a support element; a side rail including a pad eye configured to be positioned in an opening defined by a slide bed; a slide rail configured to connect to a cross brace, with or without the use of any fasteners.

Embodiments of a slide within the scope of this disclosure may comprise any combination of the aforementioned slide beds and/or side rails. Likewise, embodiments of a slide kit within the scope of this disclosure may comprise any combination of the aforementioned slide beds and/or side rails and/or support elements.

C. Example Embodiments of a Playground Slide

Following is a non-exclusive list of embodiments within the scope of the invention. It should be understood that aspects of the various embodiments may be combined in other ways to define still further embodiments.

In a first example embodiment, a playground slide includes two side rails and a slide bed attachable to the side rails, all of which are in the form of respective unitary one-piece structures and each substantially comprising plastic.

In a second example embodiment, a playground slide includes two side rails and a slide bed that each include respective complementary structures configured and arranged such that the side rails and slide bed can be releasably locked to each other by way of the complementary structures.

In a third example embodiment, a playground slide includes two side rails and a slide bed that each include respective complementary structures configured and arranged such that the side rails and slide bed can be releasably locked to each other solely by way of the complementary structures.

In a fourth example embodiment, a playground slide includes two side rails and a slide bed that each include respective complementary structures such that the side rails and slide bed can be releasably locked to each other by way of the complementary structures, and one or more of the slide bed and side rails is in the form of a unitary one-piece structure that is at least partly hollow and comprises plastic.

In a fifth example embodiment, a playground slide includes two side rails and a slide bed attachable to the slide rails, the slide bed in the form of a unitary one-piece structure that is at least partly hollow and comprises plastic, and the slide bed including a plurality of ribs that alternate with a plurality of tack-offs to form a structure that is relatively flexible relative to a first axis and relatively resistant to bending relative to a second axis.

In a sixth example embodiment, a playground slide includes two side rails and a slide bed that can be attached and locked to the side rails without the use of threaded fasteners, nails, or rivets.

In a seventh example embodiment, a playground slide includes two side rails and a slide bed, the side rails each including a plurality of extended elements configured to engage corresponding structure of the slide bed such that the slide bed can be attached to the side rails without the use of threaded fasteners, nails, or rivets.

In an eighth example embodiment, a playground slide includes two side rails and a slide bed, the side rails each including a plurality of extended elements configured to engage corresponding structure of the slide bed such that the slide bed can be attached, and locked, to the side rails without the use of threaded fasteners, nails, or rivets.

In a ninth example embodiment, a playground slide consists of as few as three separate parts, namely, a slide bed and two side rails.

In a tenth example embodiment, a playground slide consists of, at most, five separate parts, where the five separate parts include a slide bed and two side rails.

In an eleventh example embodiment, a playground slide includes a slide bed with one, two, or more, waves, and further includes two side rails to which the slide bed is attachable, one or more of the slide bed and side rails in the form of a unitary one-piece structure that is at least partly hollow and comprises plastic.

In a twelfth example embodiment, a playground slide includes a slide bed that is substantially flat, and further includes two side rails to which the slide bed is attachable, one or more of the slide bed and side rails in the form of a unitary one-piece structure that is at least partly hollow and comprises plastic.

In a thirteenth example embodiment, a playground slide includes two side rails and a slide bed that each include respective complementary structures such that the side rails and slide bed can be releasably locked to each other solely by way of the complementary structures, and the playground slide includes one or more support elements attachable to the side rails and positioned beneath an underside of the slide bed.

In a fourteenth example embodiment, a playground slide includes two side rails and a slide bed that each include respective complementary structures such that the side rails and slide bed can be releasably locked to each other solely by way of the complementary structures, the playground slide includes one or more support elements attachable to the side rails and positioned beneath an underside of the slide bed, and the playground slide includes a cross brace connected to each of the side rails near the bottom of the playground slide.

In a fifteenth example embodiment, a playground slide includes two side rails and a slide bed that is attachable to the side rails without the use of any fasteners that extend into both the slide bed and one of the side rails.

In a sixteenth example embodiment, a playground slide includes two side rails and a slide bed attachable to the side rails without the use of separate fasteners, and the playground slide also includes a cross-brace attachable to the two side rails.

This disclosure further embraces any playground equipment that includes any of the foregoing embodiments, or one or more aspects thereof. As well, this disclosure embraces the embodiments disclosed herein both in respective assembled forms, and in respective kit forms. When in the form of a kit, the embodiment may be partly or completely disassembled.

Finally, any embodiment of the slide bed or side rails that is constructed at least partly of blow-molded plastic may have an interior that is partly, or completely, hollow. Such embodiments may also include, disposed in the interior, one or more depressions, sometimes referred to as "tack-offs." In such embodiments, these tack-offs may be integrally formed as part of a unitary, one-piece structure during a blow-molding or other forming process. The depressions may extend from a first surface, such as a first interior surface of the slide bed or rail, towards a second surface, such as a second interior surface of the slide bed or rail. The ends of one or more depressions may contact or engage the second surface so as to form a tack-off, or the ends of one or more of the depressions may be spaced apart from the second surface by a distance. In some instances, one or more depressions on a first interior surface may be substantially aligned with corresponding depressions on a second interior surface, and one or more depressions on the first interior surface may contact one or more corresponding depressions on the second interior surface so as to form a tack-off or, alternatively, one or more depressions on the first interior surface may be spaced apart from corresponding depressions on the second interior surface. In still other instances, depressions that contact each other and depressions that are spaced apart from each other may both be present in a slide bed or side rail. The depressions may be sized and configured to strengthen and/or reinforce a portion of the slide bed or side rail.

BRIEF DESCRIPTION OF THE DRAWINGS

The appended drawings contain figures of some example embodiments to further clarify various aspects of the present disclosure. It will be appreciated that these drawings depict only some embodiments of the disclosure and are not intended to limit its scope in any way. The disclosure will be described and explained with additional specificity and detail through the use of the accompanying drawings in which.

DETAILED DESCRIPTION OF SOME EXAMPLE EMBODIMENTS

Figure 1:
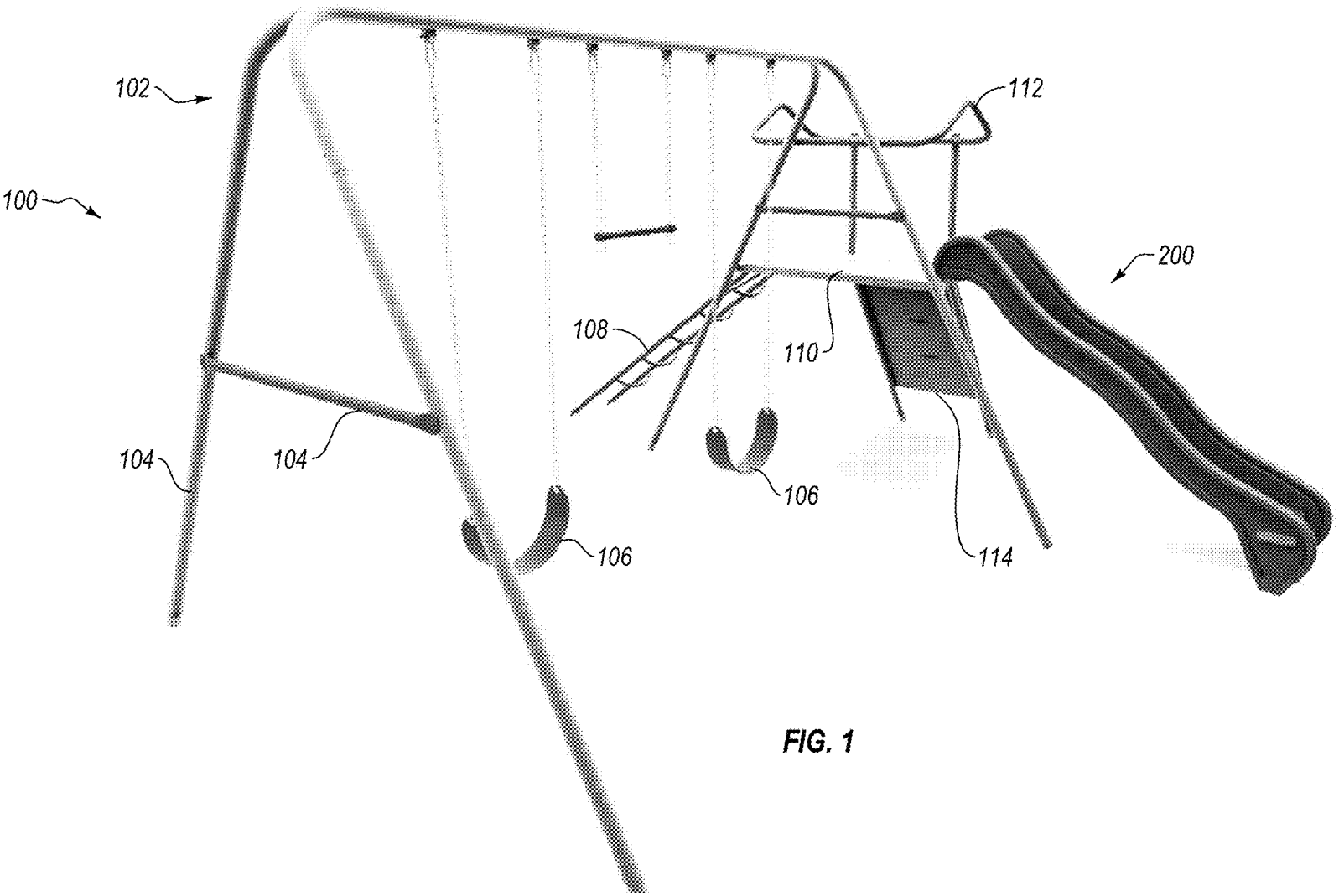
FIG. 1 is a perspective view of an example environment in which a playground slide may be employed.

The present disclosure is generally concerned with playground equipment. In brief, some implementations of a playground slide may have a small number of parts and can be assembled with few, or no, tools and fasteners.

A. General Aspects of Some Example Embodiments

In general, playground equipment and associated components disclosed herein, including slide beds, side rails, locking mechanisms, and complementary engagement elements, may be constructed with a variety of components and materials including, but not limited to, plastic (including injection-molded, blow-molded, roto-molded, and twin sheet plastic structures and elements) including polycarbonates, composites, metals, and combinations of any of the foregoing. Suitable metals may include steel, aluminum, and aluminum alloys, although the skilled person will understand that a variety of other metals may be employed as well and the scope of the invention is not limited to the foregoing examples. Where metal is employed in the construction of a playground component, the metal elements may take one or more forms including, but not limited to, square tube, rectangular tube, oval tube, round tube, pipe, angles, flatbar, I-shapes, T-shapes, L-shapes, round bar, square bar, rectangular bar, and combinations and portions of any of the foregoing.

Depending upon the material(s) employed in the construction of the playground equipment, a variety of methods and components may be used to connect, releasably or permanently, various elements of the playground equipment. For example, the various elements of playground equipment or component within the scope of this disclosure may be attached to each other by any one or more of allied processes such as welding or brazing, and/or mechanically by way of fasteners such as bolts, screws, pins, and rivets, for example. As disclosed herein, at least some embodiments of a playground slide can be assembled without the use of fasteners such as threaded fasteners (e.g., screws, bolts, screw nails), nails, or rivets. Such embodiments of the playground slide may also be assembled without the use of tools such as screwdrivers and hammers.

Some, none, or all of portions of a one or more of the playground equipment and its components may be coated with paint or other materials. At least some of such materials may serve to help prevent, or reduce, rust and corrosion.

Surface treatments and textures may also be applied to portions of the playground equipment. For example, the slide bed may be relatively smooth on its upper side to enable users to descend the slide bed easily, while portions of the side rails may be textured or treated in such a way as to enable a user to effectively grip the side rails.

B. Structural Aspects of Some Example Embodiments

Directing attention now to the Figures, details are provided concerning example playground equipment 100. The playground equipment 100 may include a frame 102 that includes a variety of frame elements 104. The frame elements 104 can take any suitable form, such as tubular metal pieces for example. In some embodiments, the playground equipment 100 includes one or more swings 106 suspended from the frame 102. The playground equipment 100 can also include one or more elements such as a ladder 108, an elevated platform 110 and associated railing 112, ramp 114, and any subset of the foregoing. The disclosed example playground equipment 100 may also include a playground slide 200 that can be connected, either permanently or detachably, to another element of the playground equipment 100, such as the elevated platform 110 for example.

Figures 2A, 2B:
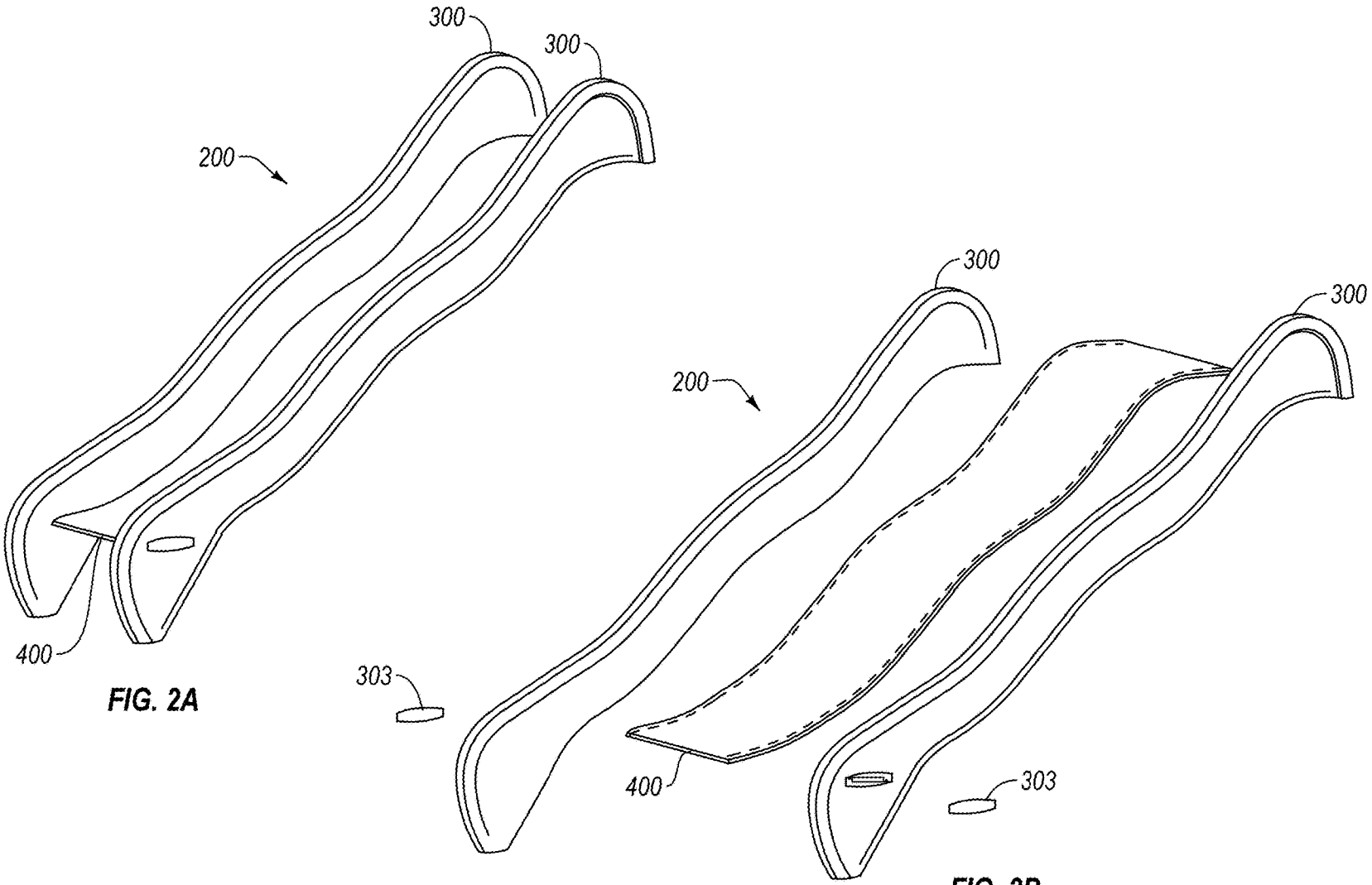
FIG. 2*a* is a front perspective view of an example playground slide.
FIG. 2*b* is an exploded view of an example playground slide.

Directing attention now to FIGS. 2*a* and 2*b*, example embodiments of the playground slide 200 may be simple in their construction. In this particular example, the playground slide 200 comprises only three primary elements, namely, first and second side rails 300 and a slide bed 400. The side rails 300 may be substantial mirror images of each other in terms of their respective physical configurations. As generally indicated in FIGS. 2*a* and 2*b*, the side rails 300 are configured to connect to, and support, the slide bed 400. Finally, and as explained elsewhere herein, plates 303 may be included that can be used to display a manufacturer logo or trademark while also functioning as part of a locking mechanism.

Figure 8B:
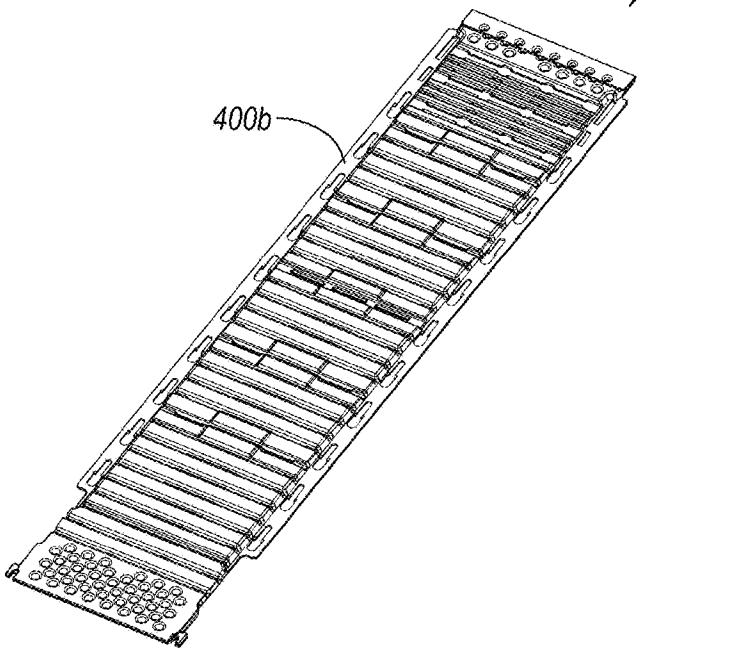
FIG. 8*b* is a bottom perspective view of an example slide bed.
Figure 8A:
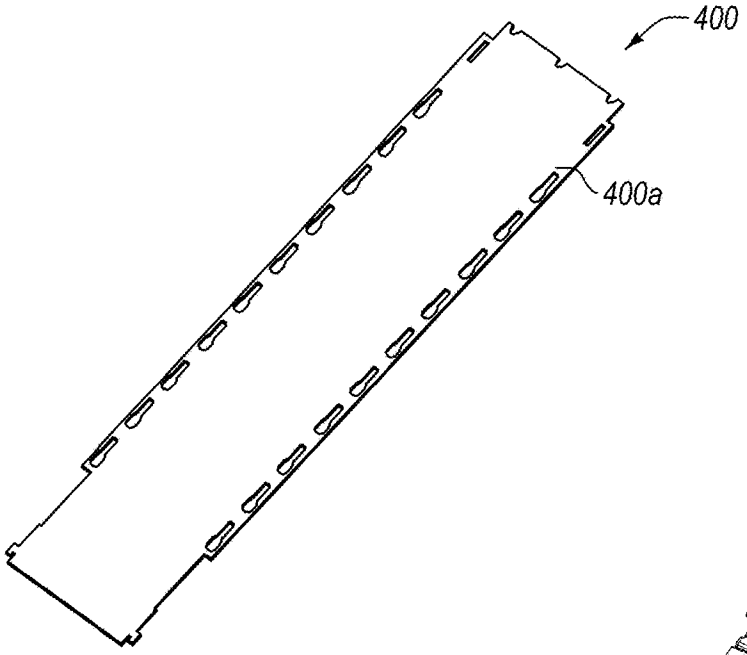
FIG. 8*a* is a top perspective view of an example slide bed.

In FIGS. 2*a* and 2*b*, the slide bed 400 is disclosed as incorporating one or more waves. However, this is not required, and the slide bed 400 may be substantially flat, that is, substantially free of any waves or curves. Such a slide bed 400 may be shaped generally as indicated in FIGS. 8*a*-8*b*, discussed below. Embodiments of the side rails 300 may be correspondingly configured to support the flat slide bed 400 in such a way as to maintain the substantially flat configuration of the slide bed 400. Except in this regard, the flat slide bed 400 may be similar, or identical, to the slide bed 400. For example, the straight slide bed may be configured such that it can be attached, and locked, to a pair of side rails 300 without the use of threaded fasteners, nails, or rivets.

Figures 3A, 3B, 3C:
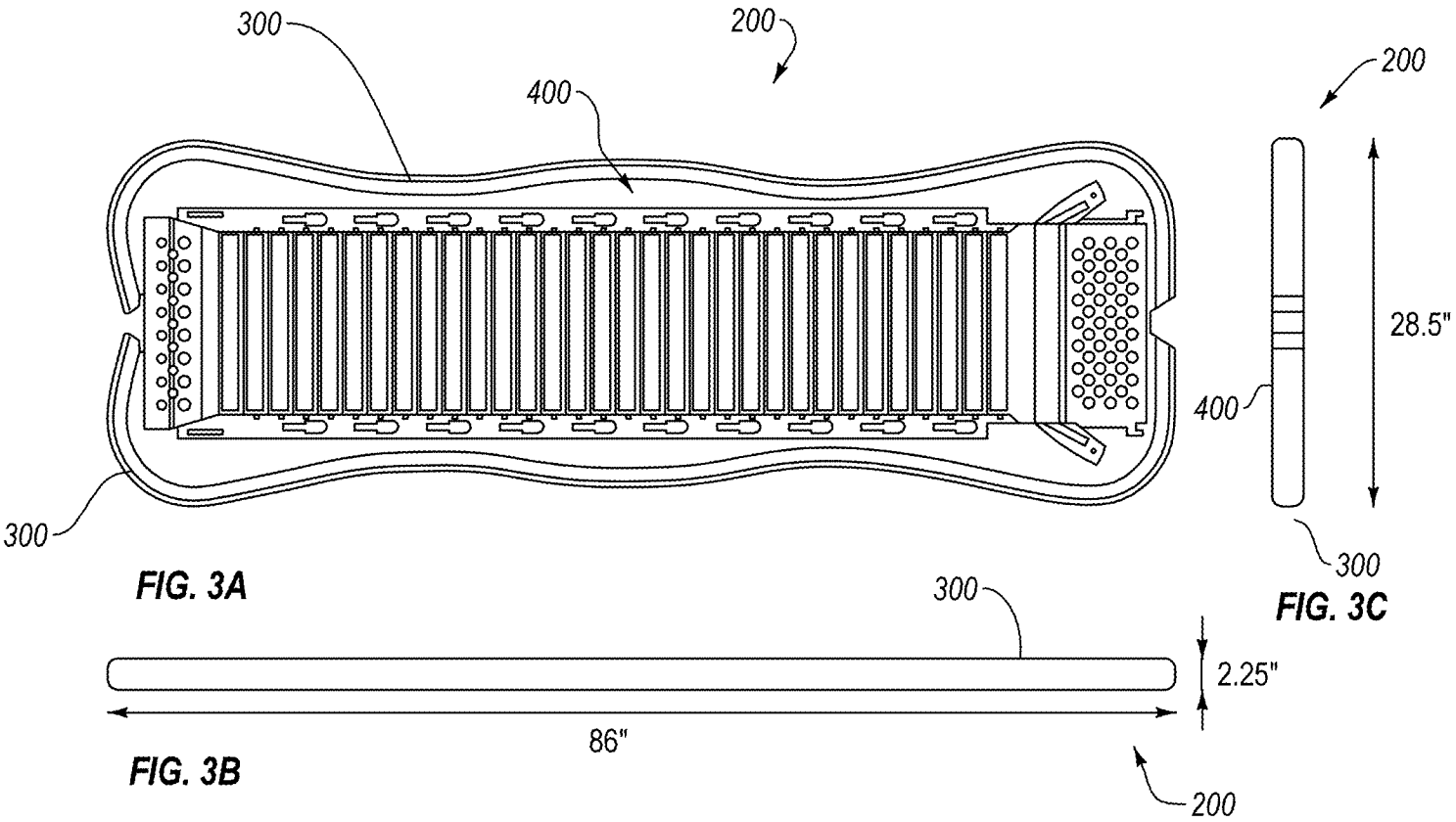
FIG. 3*a* is a top view of an example packaging and shipping arrangement of a playground slide.
FIG. 3*b* is a side view of an example packaging and shipping arrangement of a playground slide.
FIG. 3*c* is an end view of an example packaging and shipping arrangement of a playground slide.

With attention now to FIGS. 3*a*-3*c*, it can be seen that the relatively simple construction of at least some embodiments of the playground slide 200 lends itself to the use of compact packaging and shipping arrangements. Such compactness may be beneficial in that it can enable a large number of disassembled playground slides 200 to be fit within a relatively small space. Moreover, because at least some embodiments of the playground slide 200 do not require or use fasteners, the packaging of the disassembled playground slide 200 may be simplified and reduced even further.

By way of illustration, and with continued reference to FIGS. 3*a*-3*c*, the example playground slide 200 can be sufficiently broken down that the two side rails 300 and slide bed 400 can fit together within a space that is about 86 inches long, about 29 inches wide, and slightly more than about 2 inches thick. In the example of FIGS. 3*a*-3*c*, the slide bed 400 is positioned between, and resides at least partly on, the side rails 300, though other arrangements can alternatively be employed.

Figure 4D:
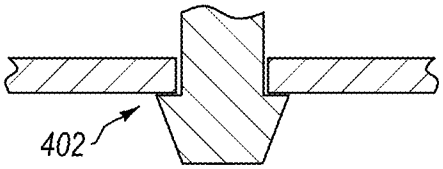
FIG. 4*d* is a detail view of example complementary engaging structures.
Figure 4C:
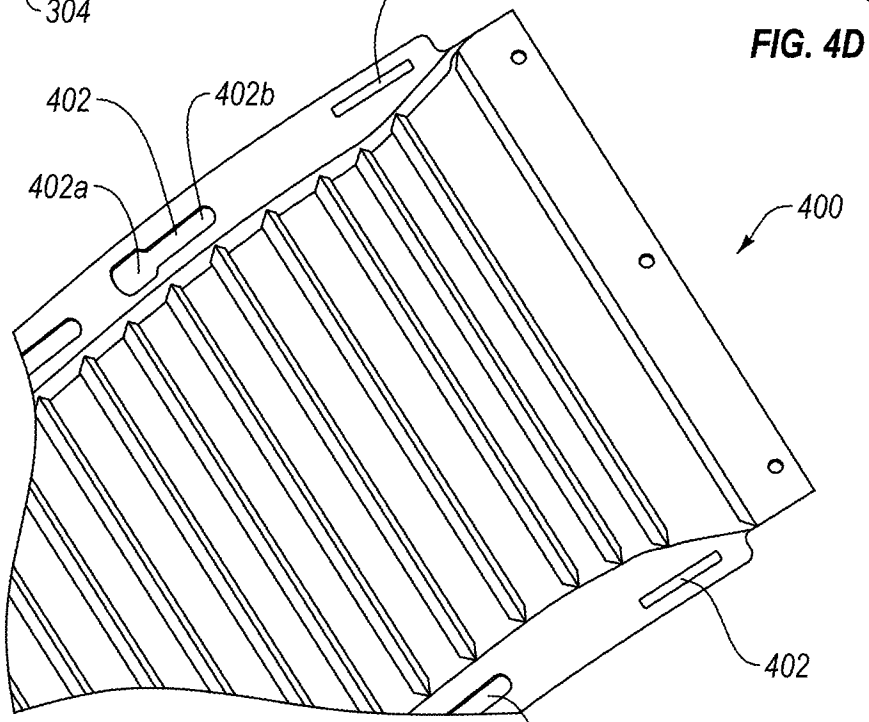
FIG. 4*c* is a partial perspective view of an example slide bed that includes an example of an engagement element configured to engage complementary structure of a side rail.
Figure 4A:
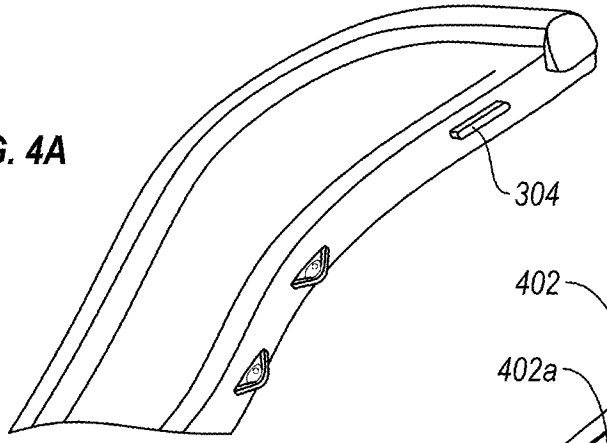
FIG. 4*a* is a partial perspective view of a side rail and disclosing an example of an engagement element configured to engage complementary structure of a slide bed.
Figure 4B:
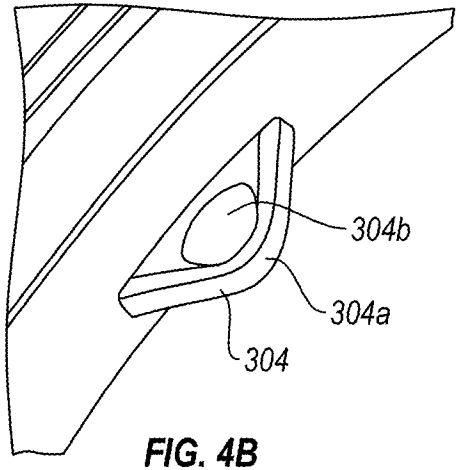
FIG. 4*b* is a detail perspective view of an example of an engagement element configured to engage complementary structure of a slide bed.

Turning now to FIGS. 4*a*-4*c*, details are provided concerning example structures for attaching the side rails 300 and slide bed 400 together. In general, the structures and mechanisms for attaching the side rails 300 and slide bed 400 together are of a nature such that the side rails 300 and slide bed 400 can be attached together, permanently or releasably, without necessitating the use of fasteners such as threaded fasteners (e.g., screws, bolts, screw nails), nails, or rivets and, correspondingly, without the need for any tools.

Figure 5:
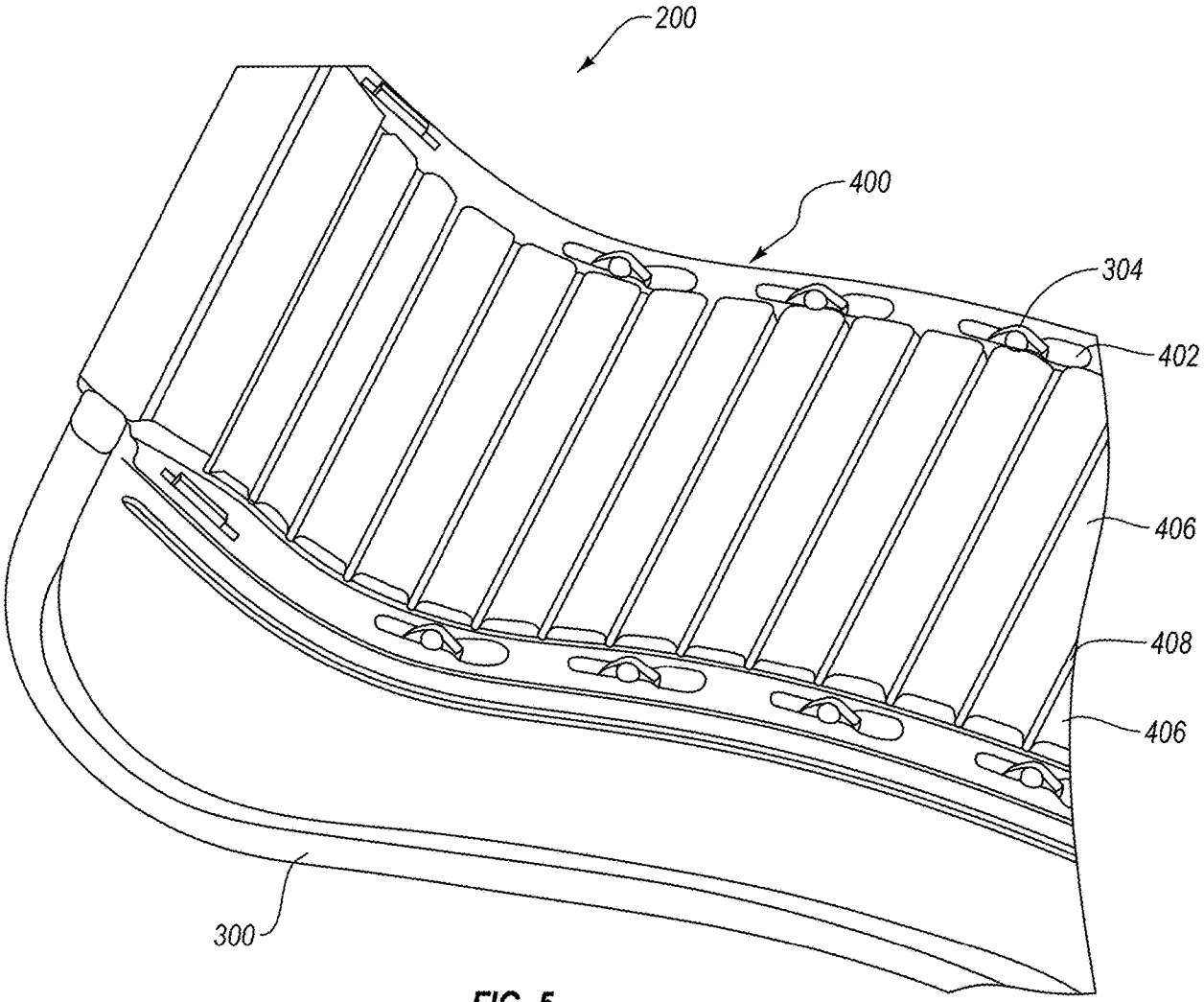
FIG. 5 is a partial perspective view of an example slide bed and side rails and FIG. 5*a* is a partial section view disclosing aspect of a rib and web arrangement of an example rib structure.

With reference to the particular example embodiment of FIGS. 4*a*-4*d*, and with attention to FIG. 5 as well, each of the side rails 300 may include one or more first complementary structures 304 that, in general, are configured to engage with corresponding second complementary structures 402 of the slide bed 400. The first complementary structures 304 may all have substantially the same configuration as each other, but that is not necessary. The same is likewise true of the second complementary structures 402. In the illustrated example, at least two different configurations of first complementary structures 304 are disclosed. Moreover, the slide bed 400 may include a plurality of second complementary structures 402 on opposing edges of the slide bed 400, while each side rail 300 may include a plurality of complementary structure 304. One or more of the number, configuration, size, spacing or orientation of the first complementary structures 304 and second complementary structures 402 can be varied as desired.

For example, the complementary structure 304 indicated in FIG. 4*b* comprises a tab 304*a* that includes a protrusion 304*b* in the form of an undercut bump, for example. In general, the tab 304*a* is configured to be engaged with first and second slot portions 402*a* and 402*b* of the second complementary structure 402. As indicated in FIG. 4*c*, the example complementary structure 402 takes the form of a slot that has a wide end and a relatively narrow end. In this particular example, the width of the widest part of the protrusion 304*b* is approximately the same as, or can be slightly greater than, a width of the first slot portion 402*a* of the second complementary structure 402, while also being substantially greater than a width of the second slot portion 402*b*. As well, a width of the base of the tab 304*a* is approximately the same as, or can be slightly greater than, a width of the second slot portion 402*b* of the second complementary structure 402.

As a result of the aforementioned example configuration of the first and second complementary structures 304 and 402, respectively, one or more tabs 304*a* can be inserted into corresponding first slot portions 402*a*, and then the slide bed 400 and/or side rail 300 moved in such a way that the protrusion 304*b* moves into the second slot portion 402*b*. Because the protrusion 304*b* is undercut, such that the relatively wider portion of the protrusion 304*b* extends above the second slot portion 402*b* while the undercut portion resides in and/or below the second slot portion 402*b*, the slide bed 400 cannot be easily pulled away from the side rail 300.

Among other things then, the first and second complementary structures 304 and 402 enable the side rails 300 and slide bed 400 to be releasably locked together solely by way of the complementary structures 304 and 402, and without requiring the use of any fasteners. Of course, fasteners can be employed in any of the disclosed embodiments and could, for example, be used, in addition to complementary structures such as 304 and 402, to attach the slide bed to the side rails and/or to attach any other components of the disclosed playground slides together. Accordingly, embodiments that include both complementary structures 304/402 as well as fasteners are contemplated within the scope of this disclosure.

The functionality of the first and second complementary structures 304 and 402, respectively, can be enhanced by positioning the slide bed 400 in such a way that the first slot portions 402*a* are oriented downward in the direction that a user would slide, as indicated in FIG. 2*a* for example. As a consequence of this orientation, a force that tends to push the slide bed 400 downward (e.g., to the left in FIG. 2*a* for example), such as might be exerted by a user sliding down the playground slide 200, may tend to enhance retention of the tab 304*a* and protrusion 304*b* in the relatively narrow second slot portion 402*b*.

As noted above, the complementary structures 304 can take a variety of different forms, which can be combined together in a single embodiment of the side rail 300. Accordingly, and with continued reference to FIG. 4*a*, at least one of the complementary structures 304 located proximate an uppermost end of the side rail 300 may take the form of a tab that is flared at its free end. By pushing the flared end of the tab through a complementary structure 402 in the form of a slot whose width is narrower than the flared end of the tab and which is located proximate an uppermost end of the slide bed 400, the slide bed 400 can be secured to the side rail 300. The flared end of the tab aids in retention of the tab in the slot.

Figures 5A, 6:
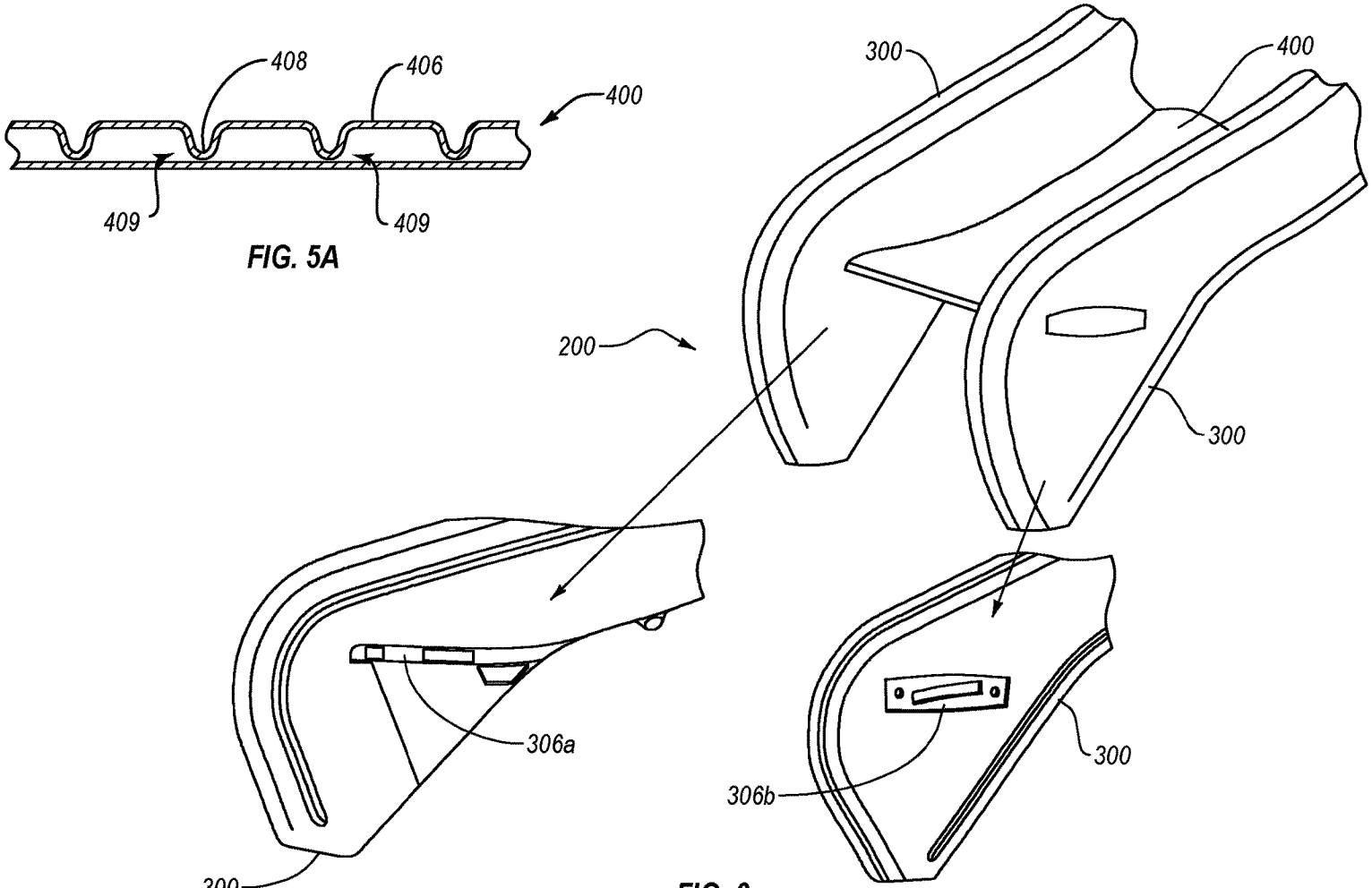
FIG. 6 is a partial exploded view of an example slide bed and side rails.

With brief reference particularly to FIG. 5, a bottom view of an upper portion of the playground slide 200 is disclosed. As will be appreciated from that FIG., this example embodiment of the playground slide 200 is configured such that the slide bed 400 is suspended on the underside of the side rails 300. The slide bed 400 is prevented from any substantial separation from the side rails 300 by the construction and interaction of the complementary structures 304 and 402, discussed elsewhere herein. As shown in FIG. 5*a*, and noted elsewhere herein, one or more of more of the webs 408 may comprise a tack off 409.

Figure 7B:
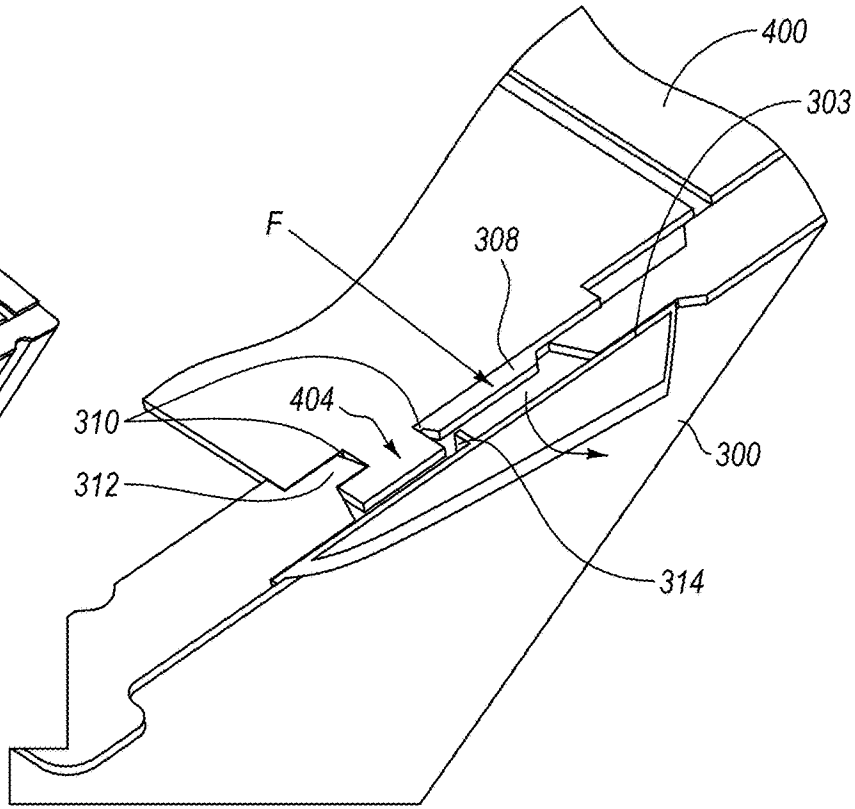
FIG. 7*b* is a detail perspective view of a locking mechanism for a slide bed and side rail.
Figure 7A:
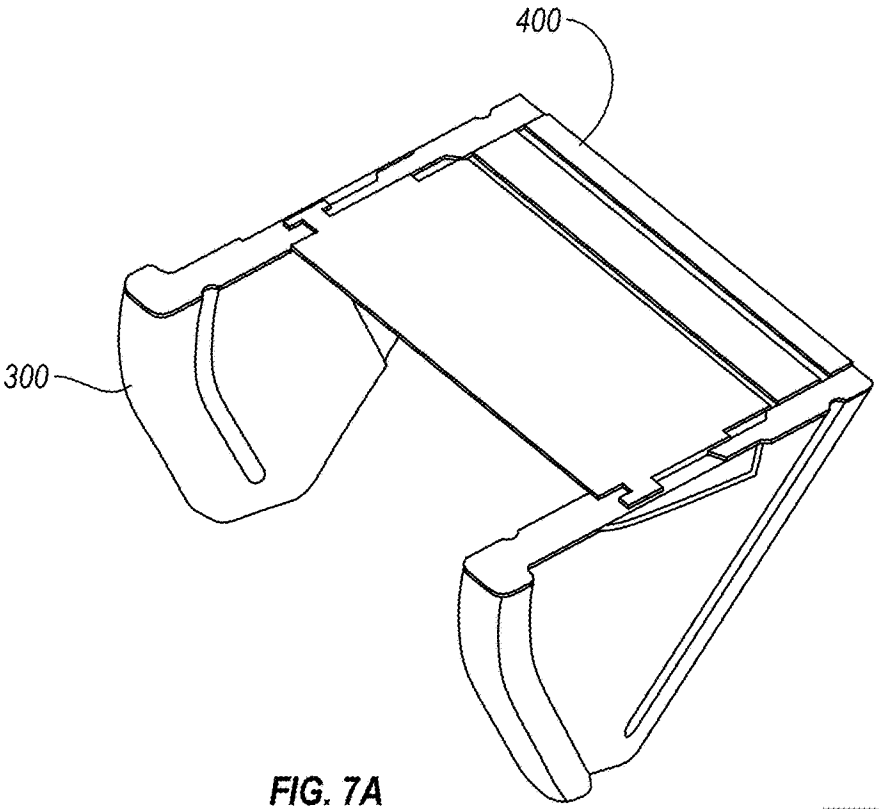
FIG. 7*a* is a partial section view of an example slide bed and side rails.

With reference now to FIGS. 6, 7*a* and 7*b*, further details are provided concerning mechanisms for connecting and/or locking the side rails 300 with the slide bed 400. As indicated in FIG. 6, the side rails 300 may include, in addition to complementary structures 304, elements of a locking mechanism that can be used to lock the side rails 300 and slide bed 400 together. The locking mechanism can be configured to permanently, or releasably, lock the side rails 300 and slide bed 400 together. In the example of FIG. 6, the side rails 300 may each include inside and outside interlock pockets 306*a* and 306*b*, respectively, that house and/or comprise elements of a locking mechanism. As indicated in FIG. 6, each of the inside and outside interlock pockets 306*a* and 306*b* may include a portion that defines an opening that extends completely through the side rail 300.

Turning now to FIGS. 7*a* and 7*b* in particular, the side rails 300 may include a tab 308 in the inside interlock pocket 306*a*. As best shown in FIG. 7*b*, the tab 308 is resiliently hinged at its upper end such that a force 'F' exerted on the tab 308 causes the tab 308 to rotate outward in the interlock pocket 306*a* in the direction indicated by the arrow. This outward rotation can allow the tab 308 and a hook 404 to disengage. Additionally, the tab 308 cooperates with the structure of the side rail 300 to define a slot 310 that is configured and arranged to receive the hook 404 or other engagement element, of the slide bed 400. As indicated in FIG. 7*b*, the slot 310 has a length that is shorter than the longest portion of the hook 404. Thus, when the hook 404 is pushed toward the slot 310, the tab 308 temporarily rotates out of the way so that the hook 404 can be accommodated.

Once the hook 404 is fully positioned in the slot 310 and inside interlock pocket 306*a*, the resilient hinge of the tab 308 returns the tab 308 to the position shown in FIG. 7*b*, thereby maintaining the hook 404 in engagement with a corresponding tooth 312 or other element of the side rail 300, and preventing lateral retraction of the hook 404 from the slot 310/inside interlock pocket 306*a*. Finally, a locking tab 314 constrains the motion of the hook 404 toward the tab 308, such that the hook 404 is prevented from deflecting the tab 308 to an extent that would permit the hook 404 to be retracted from the slot 310/inside interlock pocket 306*a*. In the example of FIG. 7*b*, the locking tab 314 is an element of a plate 303 that can be snap locked into place, or otherwise attached, to the outside interlock pocket 306*b*. The plate 303 may optionally be configured to be removable, so as to enable disassembly of the playground slide 200.

As the foregoing discussion suggests, the combination of the interlock pockets 306*a* and 306*b*, tab 308, slot 310, hook 404, tooth 312, and locking tab 314 comprise one or more locking mechanisms that may be employed to permanently or releasably connect the side rails 300 and slide bed 400. While certain functions are associated with each of the aforementioned elements in the example embodiment discussed above, it will be appreciated that the allocation of the functions among the elements is not fixed and, in other embodiments, the functions may be allocated in other ways.

Directing attention next to FIGS. 8*a* and 8*b*, and with continued reference to FIG. 5, details are provided concerning an example embodiment of a slide bed 400. Embodiments of the slide bed 400 can be produced using any suitable process(s), examples of which include, but are not limited to, injection-molding, blow-molding, roto-molding, and twin sheet processes. Thus, at least some embodiments of the slide bed 400 may take the form of a unitary one-piece structure. Embodiments of the slide bed 400 can comprise a variety of materials, including plastic. One particular example of a plastic is high-density polyethylene (HDPE), although other plastics can also be used.

As indicated in the aforementioned Figures, the slide bed 400 may include a top side 400*a* and a bottom side 400*b*. The top side 400*a* may have a relatively smooth surface or configuration so as to enable a user to readily slide along the surface when the slide bed 400 is employed as part of a playground slide 200.

The bottom side 400*b* of the slide bed 400 may include a plurality of ribs 406. The ribs 406 may be arranged transversely relative to a length of the slide bed 400, as shown in FIGS. 5 and 8*b*, or can be arranged in any other desired orientation. Adjacent ribs 406 may be separated by a web 408. The web 408 may thus define the width of a gap between successive ribs 406. The example ribs 406 have a generally rectangular cross-section, but that particular shape is not required. Other example cross-section shapes include, but are not limited to, square, triangular, hemispherical, polygonal, and elliptical or any other curved shape, or portions of any of the foregoing. Ribs of different cross-section shapes can be combined together in a single embodiment of the slide bed 400. More generally, one or more of the size, shape, spacing, orientation, or number of ribs 406 can be varied as desired.

Rib configurations, such as the example disclosed in FIGS. 5 and 8*b*, may be beneficial in a variety of respects. For example, the rib configuration imparts flexibility to the slide bed 400, by virtue of the webs positioned between the ribs. One example illustrating this flexibility is the wave shape of the slide bed 400 in FIG. 2*b*. The width of the webs and the height of the ribs also cooperate to define the extent to which the slide bed 400 is flexible. For example, relatively narrow webs and/or high ribs correspond to a relatively less flexible slide bed 400 since, as the slide bed 400 is bent, closely spaced and/or relatively higher ribs will contact each other, thus preventing further bending, relatively sooner than a configuration with relatively wider webs and/or shorter ribs.

As well, because each rib 406 in the illustrated example, and in at least some other embodiments not specifically illustrated, is configured generally in the form of a box girder, the ribs may provide lateral stiffness, rigidity and strength in a direction that is generally transverse to a length of the slide bed 400, i.e., in a direction generally parallel to the length of the ribs 406. This is the case even if the ribs are partly, or substantially, hollow, as they are in at least some embodiments. Thus, the rib configuration likewise enables a slide bed 400 construction that is sufficiently rigid and strong in the transverse direction that no supplemental supports or strengthening members are required to support the slide bed 400 between the side rails 300.

C. An Alternative Embodiment of a Playground Slide

Directing attention now to FIGS. 9-12*c*, details are provided concerning another embodiment of a playground slide, denoted generally at 500. Except as noted in the following discussion, the playground slide 500 may be similar, or identical, to the embodiment of FIGS. 1-8*b*. Thus, the following discussion focuses primarily on selected differences between the two embodiments.

Figure 9A:
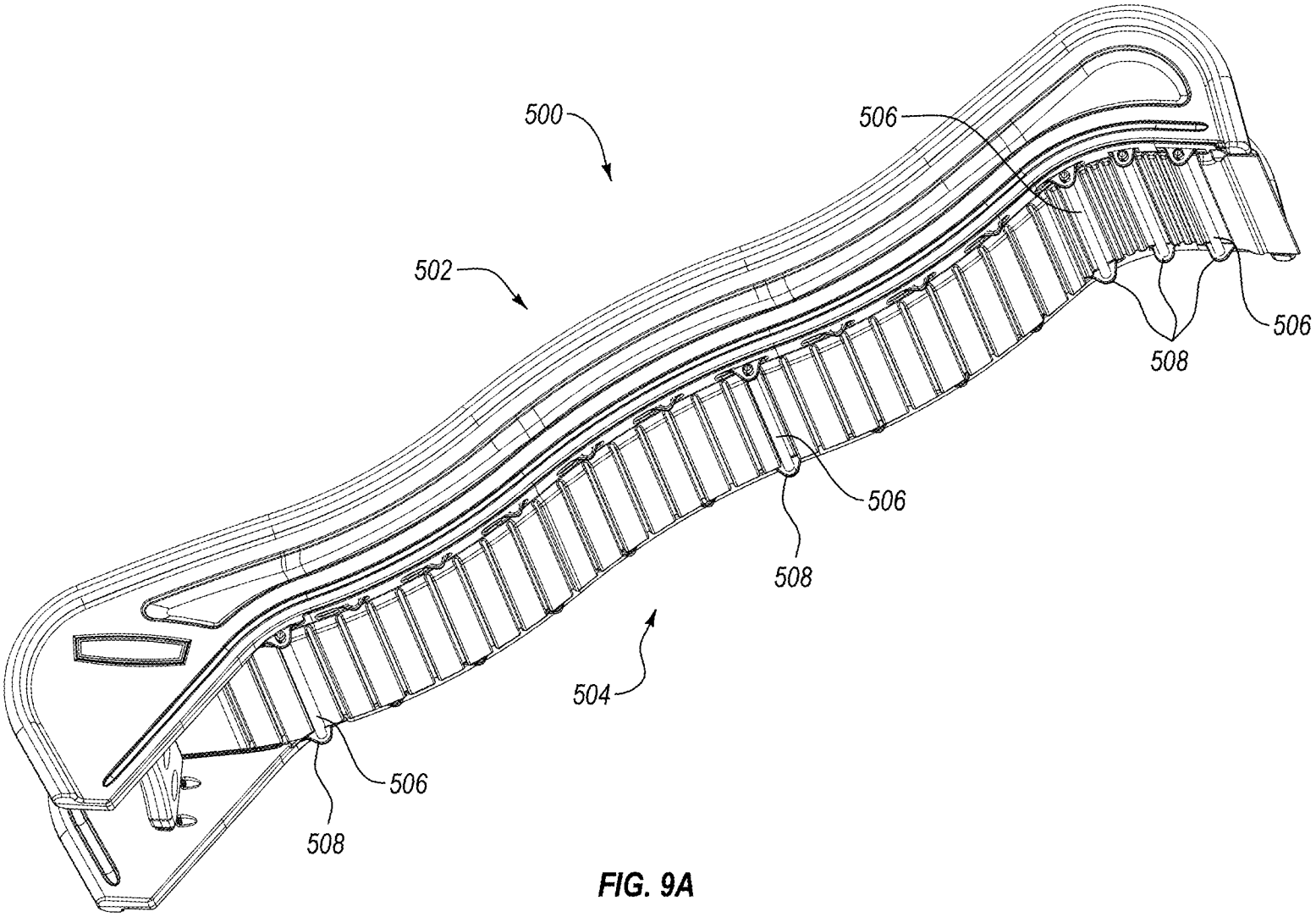
FIG. 9*a* is a side perspective view of an embodiment of a playground slide.
Figure 9B:
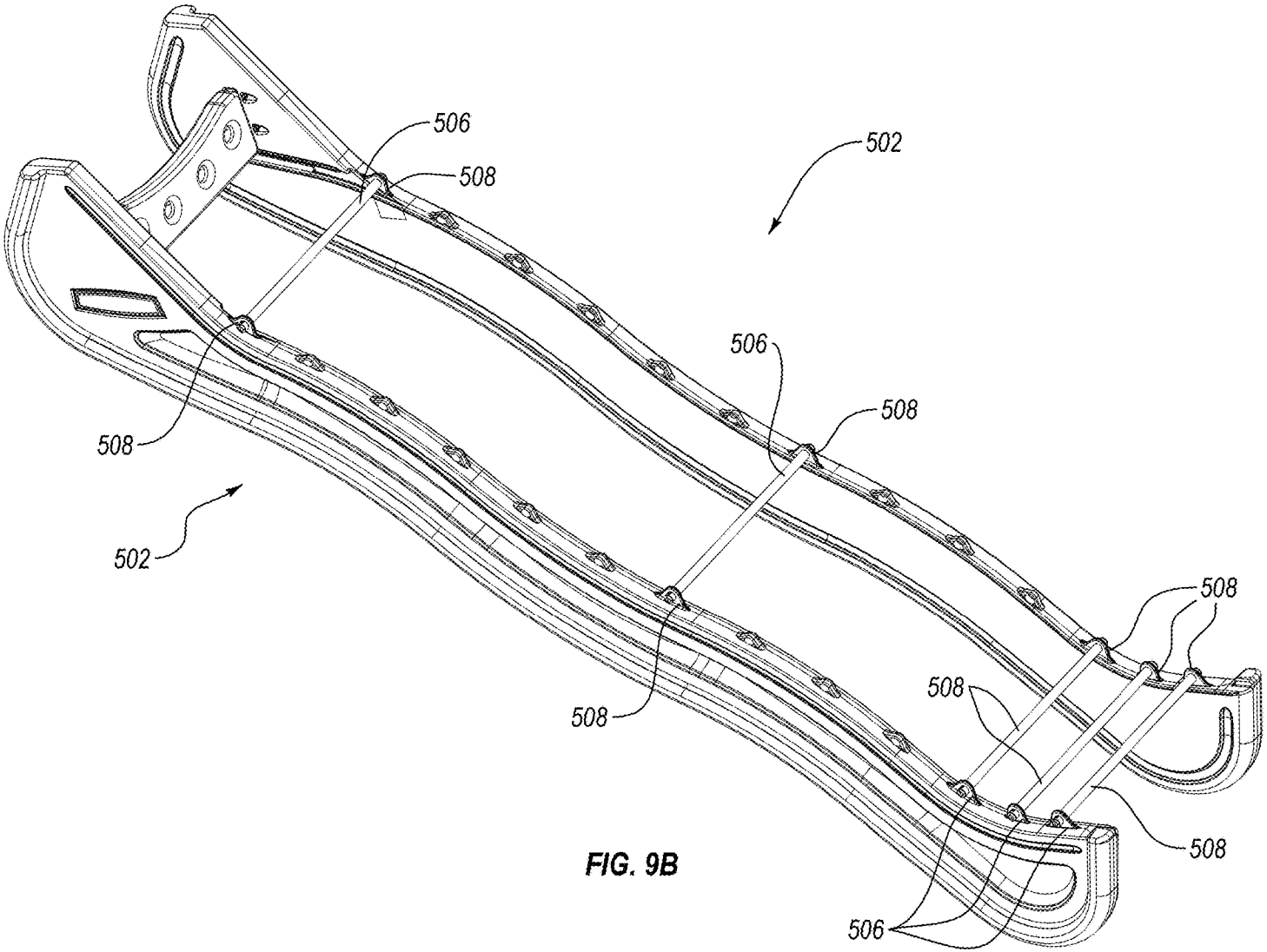
FIG. 9*b* is a bottom perspective view of an embodiment of a playground slide.
Figure 9C:
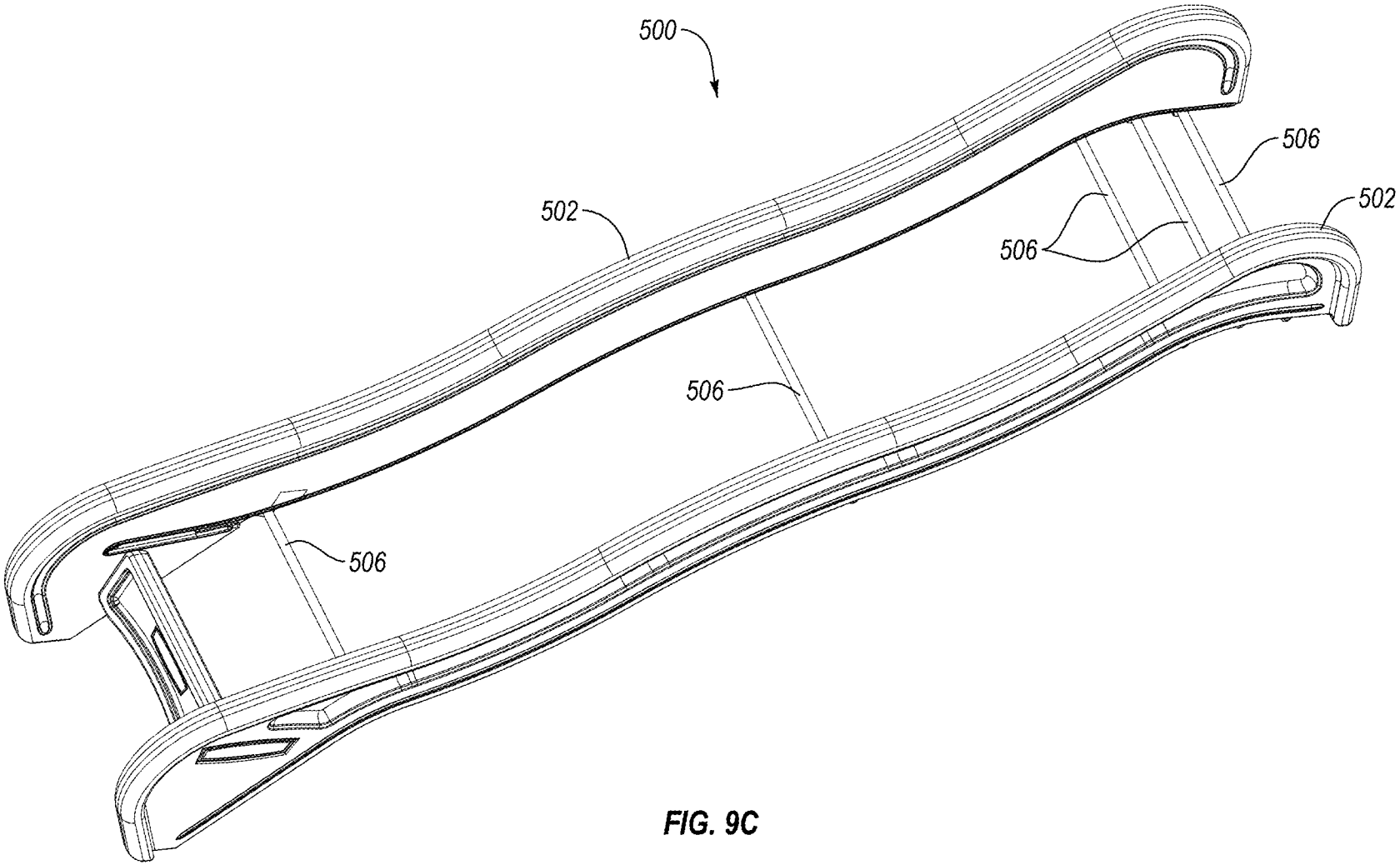
FIG. 9*c* is a top perspective view of an embodiment of a playground slide.

As indicated in FIGS. 9*a*-9*c*, the playground slide 500 may include a pair of side rails 502 that connect to, and support, a slide bed 504. The slide bed 504 may be connected to the undersides of the side rails 502. As well, one or more support elements 506 can be provided at one or more locations beneath the slide bed 504 so as to support the slide bed 504. The support elements 506 can be in contact with the underside of the slide bed 504, but that is not required. Accordingly, in some embodiments, the support elements 506 may be located near, but not in contact with, the underside of the slide bed 504. The support elements 506 can be made of any suitable materials. Some examples include tubular steel, or solid steel rod. Any other suitable materials, including metal and/or plastic, can likewise be employed.

In the illustrated example, three support elements 506 are provided where forces and/or loads are expected to be greatest during use of the playground slide 500. In particular, support elements 506 are provided near the upper end of the playground slide 500, another support element 506 is located near the middle of the playground slide 500, and an additional support element 506 is located near the lower end of the playground slide 500. This particular configuration is provided only by way of example and, accordingly, more or fewer support elements 506 can be located in the aforementioned and/or other locations on the playground slide 500. In other embodiments, the support elements 506 are omitted.

Figure 10A:
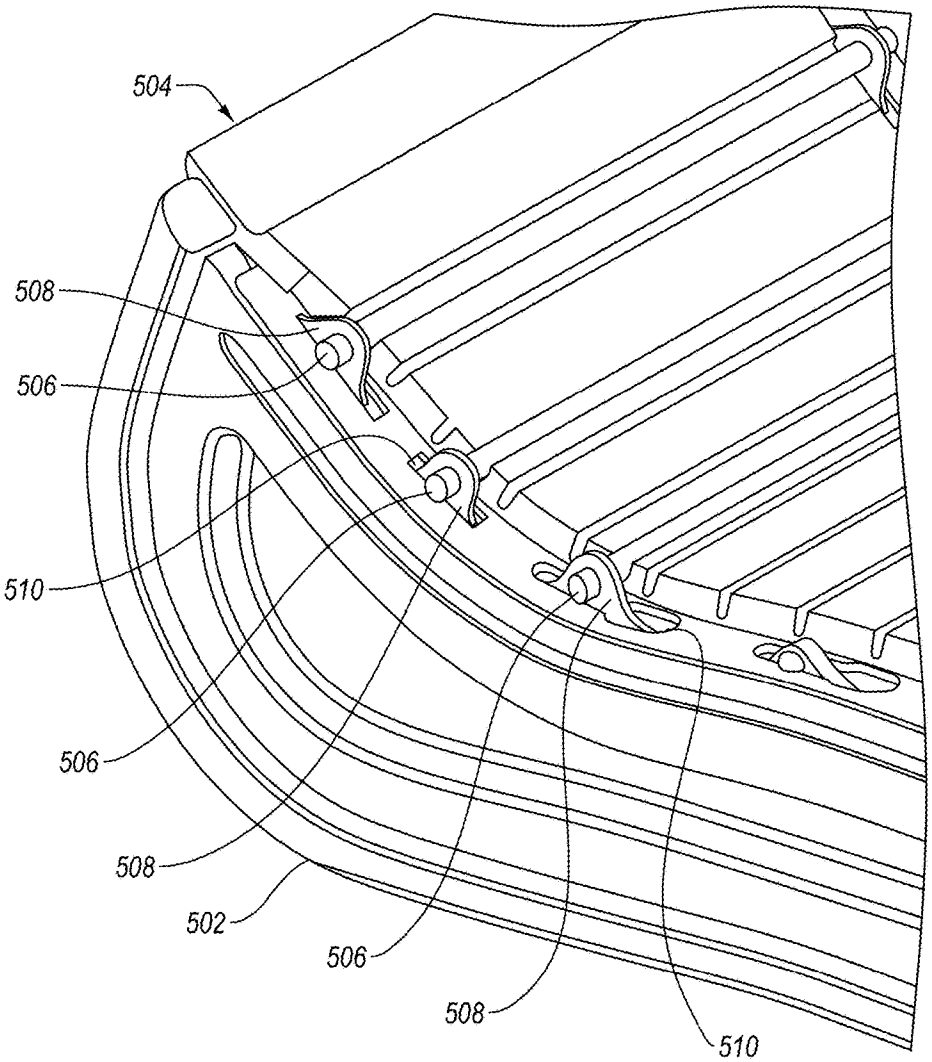
FIG. 10*a* is detail perspective view of support elements, a side rail and a slide bed.
Figure 10B:
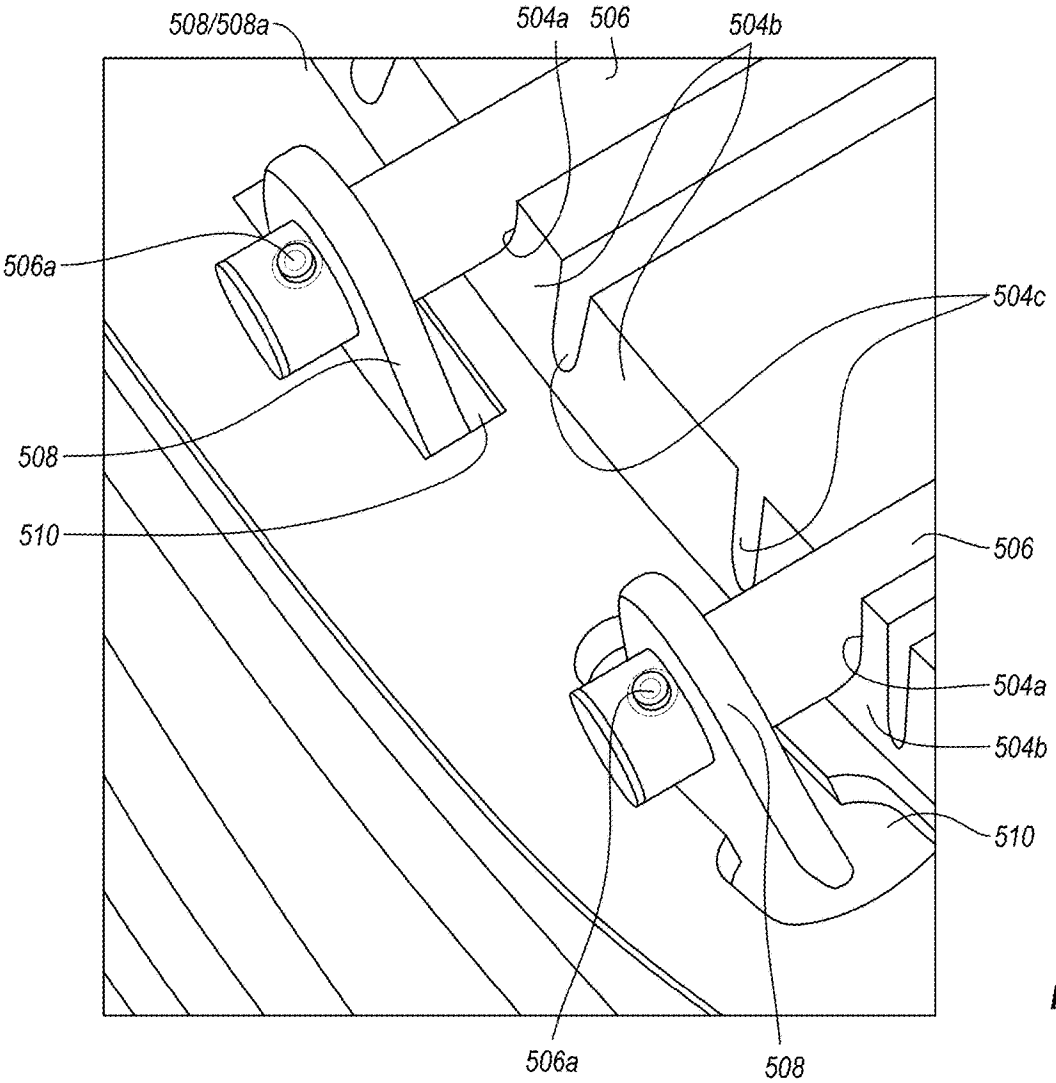
FIG. 10*b* is a detail perspective view of support elements a side rail and a slide bed.

With continued attention to FIGS. 9*a*-9*c*, and direction attention now to FIGS. 10*a* and 10*b* as well, further details are provided concerning some example support elements 506 and various related aspects of the side rails 502 and slide bed 504. As indicated in those Figures, the slide bed 504 may define one or more channels 504*a* or other elements that are configured to receive a corresponding support element 506. One or more of the channels 504*a* may be defined in a respective rib 504*b*, although that is not required and the channels 504*a* can be defined, alternatively, by other portions of the slide bed 504. In yet other instances, the support elements 506 can be received in respective channels 504*c* defined between successive ribs 504*b*.

As further indicated in FIGS. 9*a*-10*b*, the side rails 502 may include one or more pad eyes 508 that extend downward from the side rail 502 and define an opening 508*a* configured to receive a portion of a support element 506. One or both ends of the support element 506 can include a retention element 506*a*, such as a spring-loaded pushbutton, tab, or other device that helps prevent inadvertent withdrawal of the support element 506 from the opening 508*a*.

The pad eyes 508 may be integral with the side rail 502 and formed, for example, by a blow-molding, or other, process. Alternatively, the pad eyes 508 can be discrete structures that are attached, permanently or removably, to the side rail 502. In general, the pad eyes 508 can be located anywhere along the underside of side rail 502, and any number of pad eyes 508 can be employed in any given embodiment.

In the particular example of FIGS. 9*a*-9*c*, a single pad eye 508 is provided near the bottom of the playground slide 500, another pad eye 508 is provided near the middle of the playground slide 500, and three pad eyes 508 are grouped together near the top of the playground slide 500. This particular arrangement, and similar ones, may be useful in providing additional support to the slide bed 504 when the slide bed 504 is subjected to loads, as discussed in more detail below.

With continued reference to FIGS. 9-10*b*, the slide bed 504 may include one or more slots 510 or other openings that are each sized and configured to removably receive a corresponding pad eye 508. The slots 510 or other openings can have any suitable size and shape. In general, the slots 510 are long enough to enable some movement of a corresponding pad eye 508 when the pad eye 508 has been received in the corresponding slot 510. More particularly, and as explained above, when the slide bed 504 is positioned such that the pad eyes 508 extend through respective slots 510, the slide bed 504 can then be translated, or slid, relative to the side rails 502 in such a way that complementary structures, such as the complementary structures 304 discussed herein in connection with FIG. 4*b* for example, engage corresponding slots to releasably lock the slide bed 504 to the side rails 502. Once the slide bed 504 has been thus positioned, one or more support elements 506, if employed, can be put in place, for example, in the arrangement shown in FIGS. 9*a*-9*c*.

Figure 11A:
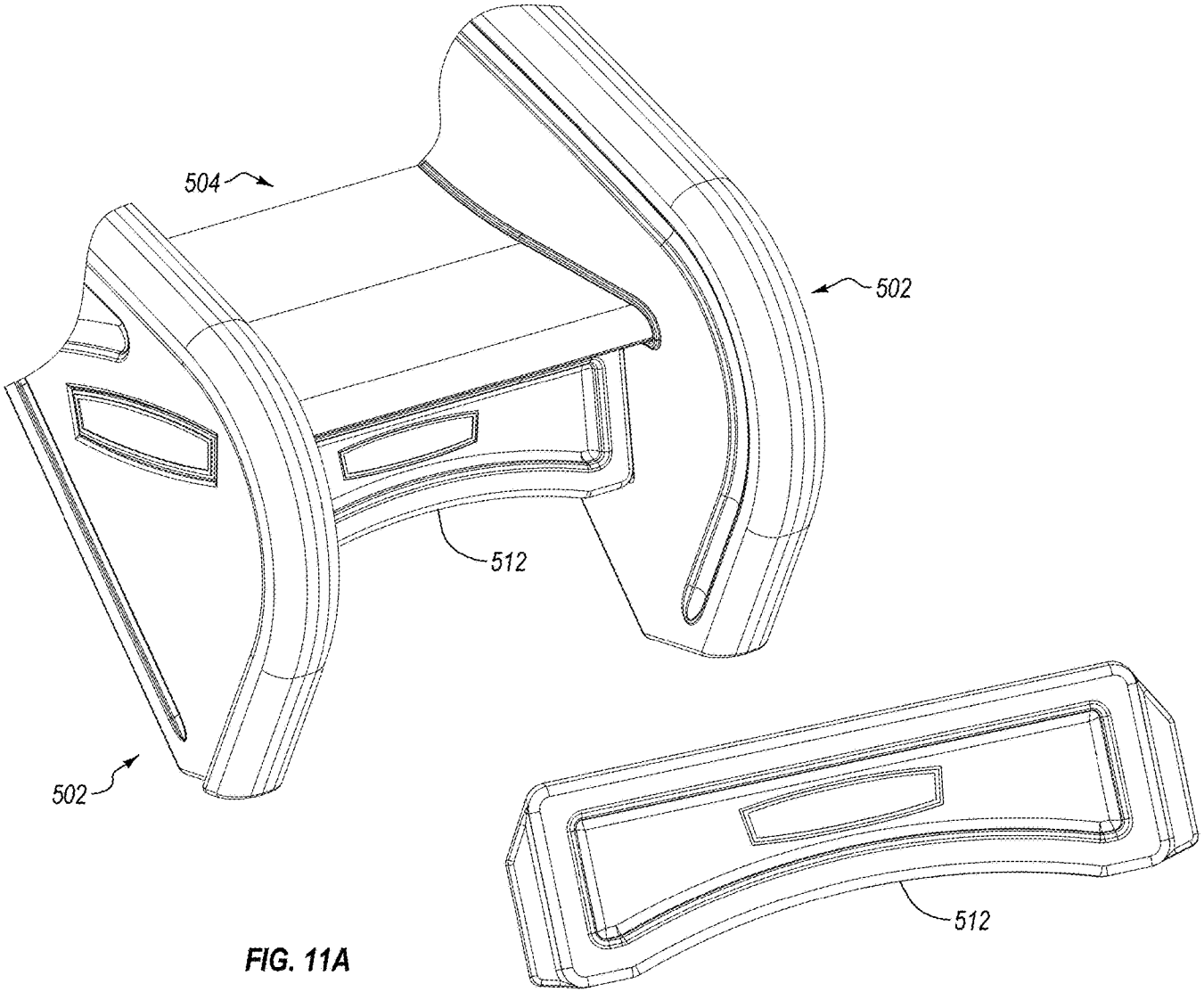
FIG. 11*a* is a front perspective view of a lower portion of a playground slide and associated brace.
Figure 11B:
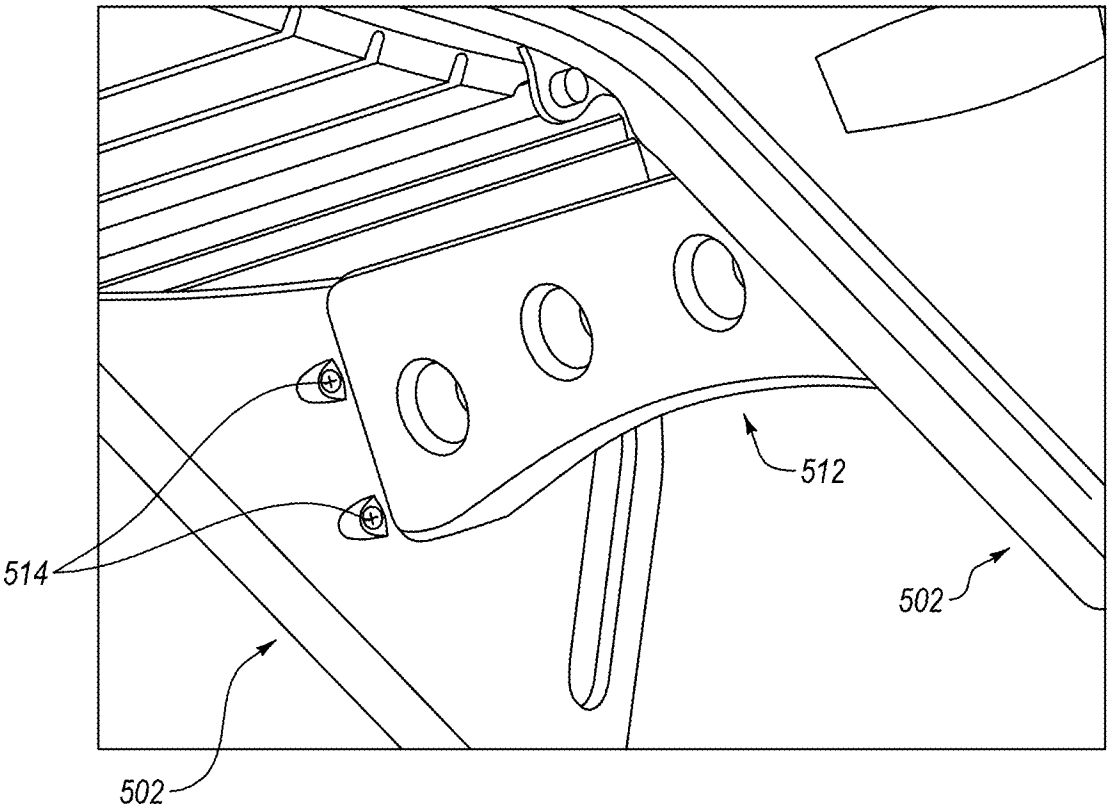
FIG. 11*b* is a rear perspective view of a lower portion of a playground slide and associated brace.
Figure 11C:
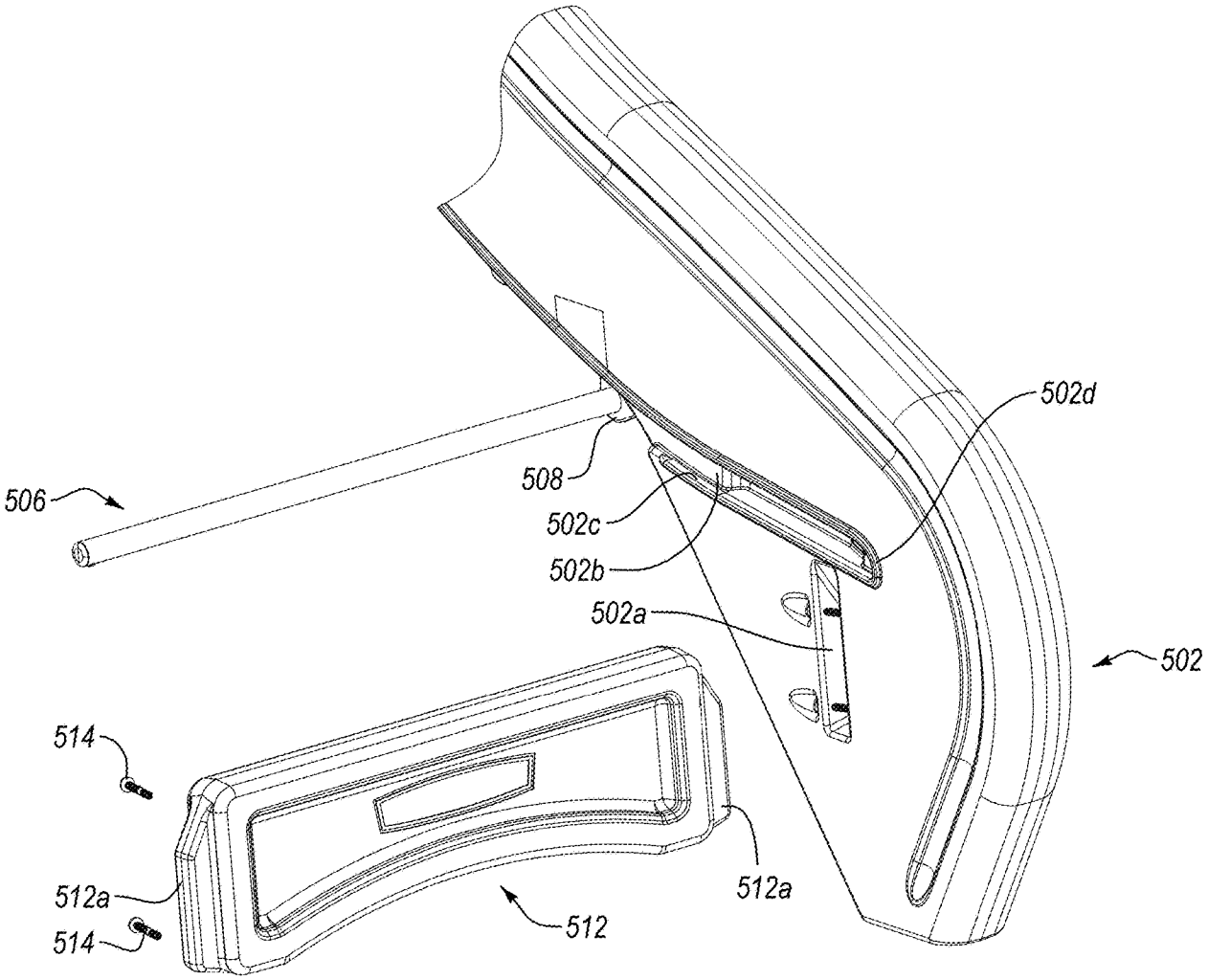
FIG. 11*c* is a front exploded view of a lower portion of a playground slide and associated brace.

Directing attention finally to FIGS. 11*a*-11*c*, details are provided concerning further aspects of some embodiments of the invention. In particular, an optional brace 512, or multiple braces 512, can be provided that supports the underside of the slide bed 504, and may also provide stiffness and support to the playground slide 500 by connecting to the two side rails 502. The brace 512 may be made of plastic, such as by blow molding for example, and/or any other suitable material(s), including metal.

In the illustrated example, the brace 512 is attached to the side rails 502 near the bottom of the playground slide 500, although the brace 512 is not required to be attached to the side rails 502 in any particular location. The brace 512 can be attached to the side rails 502 in any suitable fashion. In the illustrated example, the brace 512 may include tabs 512*a* at either end that are configured and arranged to be received in corresponding recesses 502*a* defined by the side rails 502. Two or more fasteners 514 can be used to connect the tabs 512*a* of the brace 512 to each of the side rails 502.

With particular reference now to FIG. 11*c*, and reference as well to FIG. 6, some embodiments of the side rail, such as the side rail 502, can include an optional channel 502*b* that is located on the inner portion of the side rail 502 near the bottom of the side rail 502. In general, the channel 502*b* receives a relatively short portion of an edge of the slide bed 504, as shown in FIG. 11*a* for example. More specifically, the channel 502*b* receives, by way of its upper end 502*c*, a relatively short lower portion of the edge of the slide bed 504. The closed end 502*d* of the channel 502*b* prevents further downward movement of the slide bed 504 once the bottom edge of the slide bed 504 has contacted the closed end 502*d* of the channel 502*b*.

Thus, the channel 502*b* provides a certain amount of support to the slide bed 504, though the slide bed 504 is primarily supported by complementary structures, such as the examples disclosed elsewhere herein, that are located on the underside of the side rails 502 and engage corresponding complementary structures of the slide bed (see, e.g., FIGS. 4*a*-4*c*). As discussed elsewhere herein, the slide bed 504 may also be supported by one or more support elements such as support elements 506 for example. Moreover, as thus configured and arranged, the channel 502*b* supports the lower end of the slide bed 504 without the use of fasteners, although fasteners may be used in some alternative embodiments to attach the slide bed 504 to the side rails 502.

D. Some Example Alternative Embodiments

In some alternative embodiments, the slide bed takes the form of a single solid piece of material that is not blow-molded but may, instead, be injection-molded or extruded. The wave shape of at least one of these embodiments may be created during the production process such that the resulting slide bed is at least semi-rigid and retains its wave shape even when not attached to slide rails. These example alternative slide beds can be plastic, but that is not required and other materials, such as metal for example, can be used instead. In some examples, these alternative slide beds may include complementary structures similar, or identical, to the complementary structures 402. In other alternative embodiments, the inside interlock pocket of a side rail can be eliminated and replaced with a relatively short section of groove that extends along a lower portion of the inside of the side rail. This short groove can be used to receive and retain one, some, or all, of the locking mechanism elements positioned in the inside interlock pockets disclosed herein. The groove can be less than about 15 inches long, and is positioned at a lower end of the inside of the side rail.

E. Advantageous Aspects of Some Example Embodiments

As will be apparent from the present disclosure, one or more embodiments of the invention can provide one or more advantageous and unexpected effects, relative to structures representing the state of the art, in any combination, some examples of which are set forth below. It should be noted that such effects are neither intended, nor should be construed, to limit the scope of the claimed invention in any way.

For example, one or more embodiments of the invention may be advantageous inasmuch as they enable the assembly of a playground slide, including a slide bed and side rails, with little or no use of threaded fasteners, nails, or rivets. As another example, some embodiments of the slide bed and side rails can be connected to each other without employing any fasteners that directly connect the slide bed to the side rails. As a further example, embodiments of the invention are configured to ship flat and thereby reduce shipping costs. As yet a further example, embodiments of the invention provide for a connection between the slide bed and side rails that is more substantial and stronger than such as might be provided by side rails that include a groove in which the slide bed is received. Consistently, the aforementioned connection provided by embodiments of the invention is sufficiently robust and reliable that it need not be supplemented by additional structures and reinforcements. In a further example, embodiments of the invention provide for a slide bed whose configuration provides strength and stiffness in particular aspects of the slide bed.

Although this disclosure has been described in terms of certain embodiments, other embodiments apparent to those of ordinary skill in the art are also within the scope of this disclosure. Accordingly, the scope of the disclosure is intended to be defined only by the claims which follow.

What is claimed is:

1. A panel, comprising:

a first portion defining part of a first side of the panel and including a plurality of substantially hollow ribs arranged generally parallel to each other, and each of the substantially hollow ribs is closed off at each end and is free from any openings in its upper surface, and each of the substantially hollow ribs extends to an edge of the panel, and the first portion also including a plurality of flexible webs, and one or more of the flexible webs is integral with, and connects, two successive ribs of the plurality of substantially hollow ribs; and a flexible second portion that is integral with the first portion and defines part of a second side of the panel that is disposed opposite the first side of the panel, and the second side of the panel has an interior surface, and one or more of the flexible webs forms an integral tack off with the interior surface of the second side of the panel, and a portion of one of the flexible webs is spaced apart from the interior surface of the second side of the panel; and the panel substantially comprises plastic and is in the form of a unified single-piece structure.

2. The panel as recited in claim 1, wherein the second side of the panel is substantially smooth.

3. The panel as recited in claim 1, wherein each of the substantially hollow ribs has a generally rectangular cross-sectional shape.

4. The panel as recited in claim 1, wherein one or more of the substantially hollow ribs defines a hollow interior that is substantially enclosed.

5. The panel as recited in claim 1, wherein one or more of the flexible webs defines an axis about which the panel is bendable.

6. The panel as recited in claim 1, wherein one or more of the flexible webs comprises a depression.

7. The panel as recited in claim 1, wherein the substantially hollow ribs are substantially straight.

8. The panel as recited in claim 1, wherein one or more of the substantially hollow ribs is curved.

9. The panel as recited in claim 1, wherein the substantially hollow ribs are generally parallel to an edge of the panel.

10. The panel as recited in claim 1, wherein the substantially hollow ribs are non-parallel with respect to an edge of the panel.

11. The panel as recited in claim 1, wherein an edge of the panel is substantially straight.

12. The panel as recited in claim 1, wherein the panel is substantially flexible along a first axis and the panel is substantially rigid along a second axis that is generally perpendicular to the first axis.

13. The panel as recited in claim 1, wherein the flexibility of the panel is a function of a configuration and/or location of the substantially hollow ribs.

14. A panel, comprising:

a plurality of substantially hollow ribs arranged generally parallel to each other and defining part of a first side of the panel, and the substantially hollow ribs are uniformly spaced apart from each other, and an interior of one of the substantially hollow ribs communicates with an interior of another of the substantially hollow ribs, and the panel further includes a second side that is disposed opposite the first side; and a plurality of flexible webs, one or more of the flexible webs connecting two successive substantially hollow ribs of the plurality of substantially hollow ribs, one of the flexible webs forming an integral tack off with an interior surface of the second side of the panel, and a portion of one of the flexible webs is spaced apart from the interior surface of the second side of the panel, and one or more of the flexible webs is in the form of a channel that is open at one or both ends, and the panel substantially comprises plastic and is in the form of a unified single-piece structure in which the plurality of flexible webs are integral with the plurality of substantially hollow ribs.

15. The panel as recited in claim 14, further comprising a first complementary engagement structure configured to engage a second complementary engagement structure of another panel or structure.

16. The panel as recited in claim 14, wherein each of the flexible webs defines a respective axis about which the panel is bendable.

17. The panel as recited in claim 14, wherein the panel is substantially more flexible in a first direction than in a second direction that is generally perpendicular to the first direction.

18. The panel as recited in claim 14, wherein each of the flexible webs is immediately adjacent to the two successive substantially hollow ribs between which that flexible web is disposed.

19. The panel as recited in claim 14, wherein the substantially hollow ribs all have substantially the same size and shape.

20. The panel as recited in claim 14, wherein the substantially hollow ribs are configured and arranged so that the panel is bendable into a circular configuration about an axis that extends across another axis of the panel.

21. The panel as recited in claim 14, wherein the substantially hollow ribs are distributed over a majority of a dimension of the panel.

22. The panel as recited in claim 14, wherein one of the substantially hollow ribs differs from another of the substantially hollow ribs in any one or more of the characteristics: size; shape; length; or, orientation.

* * * * *